US006719586B2

(12) United States Patent
Weidner

(10) Patent No.: US 6,719,586 B2
(45) Date of Patent: Apr. 13, 2004

(54) ELECTRICAL CONNECTOR WITH ANTI-TIP FEATURE TO PREVENT TIPPING DURING ASSEMBLY

(75) Inventor: Kevin Edward Weidner, Hummelstown, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/132,104

(22) Filed: Apr. 25, 2002

(65) Prior Publication Data

US 2003/0153209 A1 Aug. 14, 2003

Related U.S. Application Data

(60) Provisional application No. 60/356,508, filed on Feb. 12, 2002.

(51) Int. Cl.[7] ..... H01K 13/00
(52) U.S. Cl. ..... 439/581; 439/63; 439/108
(58) Field of Search ..... 439/578–585, 439/607–610, 108

(56) References Cited

U.S. PATENT DOCUMENTS 4,666,231 A * 5/1987 Sheesley et al. ..... 439/581
5,112,249 A * 5/1992 Henry et al. ..... 439/581
5,326,280 A * 7/1994 Briones et al. ..... 439/581
5,516,307 A * 5/1996 Cartesse et al. ..... 439/581
RE36,065 E * 1/1999 Andrews et al. ..... 439/608
6,164,977 A * 12/2000 Lester ..... 439/63
6,224,421 B1 * 5/2001 Maturo, Jr. ..... 439/581
6,319,016 B1 * 11/2001 Juntwait ..... 439/63

OTHER PUBLICATIONS

Drawing entitled "OSM Right Angle Printed Wiring Board Jack Receptacle", Code Ident, No. 26805 (2064–0000–50,) M/A–COM, Inc., drawn by R.E.B. May 12, 1967, checked by BW Jul. 2, 1968, approved Jul. 2, 1968.
Drawing entitled "Jack, Rtang, 50 OHM, PCB, BNC", Ident. No. 415218, AMP, Tyco Electronics, Harrisburg, PA., approved Nov. 1, 1995.

* cited by examiner

*Primary Examiner*—Hien Vu

(57) ABSTRACT

An electrical connector adapted to prevent tipping during a board assembly processes is provided including a connector body, a signal contact, a grounding post, and an anti-tipping lock. The connector body includes a separable interface end and a mounting end. The mounting end is adapted to be assembled to a circuit board. The separable interface end includes a mating contact that joins a mating connector and contact. The signal contact and grounding post extend from the mounting end. The anti-tipping lock is mounted to the connector body, and includes a board mounting feature extending from the anti-tipping lock. The board mounting feature extends in a direction substantially parallel to the direction along which the signal contact is joined to the circuit board. The board mounting feature is adapted to maintain the connector assembly in place when the connector assembly is mounted to an electrical component, such as a circuit board.

18 Claims, 7 Drawing Sheets

ELECTRICAL CONNECTOR WITH ANTI-TIP FEATURE TO PREVENT TIPPING DURING ASSEMBLY

RELATED APPLICATIONS

This application claims priority from U.S. Provisional Application No. 60/356,508 filed Feb. 12, 2002, which is expressly incorporated by reference herein in its entirety, including the specification, claims, abstract, and drawings.

BACKGROUND OF THE INVENTION

Certain embodiments of the present invention generally relate to an electrical connector that prevents tipping of an electrical connector system during the assembly process.

Electrical connectors are often mounted to electrical components such as circuit boards to allow electrical communication between different components. One type of connector is a right angle connector, which allows electrical communication along two paths that are substantially perpendicular to one another. Such a connector is useful, for example, in a system containing a number of circuit boards stacked in close proximity to each other, where external connectors can only access the circuit boards from the side due to space considerations.

The connectors are typically placed on a circuit board and then soldered while in place to provide electrical communication between the circuit board and the connector. However, the right angle connectors are not stable when placed on the circuit board and can tip relative to the circuit board before soldering. Hence, the connector may become misaligned with the circuit board and fixed in this misaligned orientation, or be unable to be fixed at all. The tipping and resulting misalignment requires time consuming and costly re-working or re-placing of the connector, and impedes the use of automated assembly processes.

To address the foregoing problem, the connector may be manually held in place by an assembly person. This, however, requires expensive hand assembly and prevents the use of automation. Alternately, fixturing may be employed to hold the connector in place. The use of fixtures requires the added expense of making a fixture as well as the time to place the fixture before soldering the connector to the board and to remove the fixture after soldering. Another solution currently attempted is to use a counterweight to balance the connector. Counterweights, however, can take up too much space on the circuit board, which is often at a premium in electrical systems.

It is an object of at least certain embodiments of the present invention to overcome the above-noted and other disadvantages of floating connectors.

BRIEF SUMMARY OF THE INVENTION

At least one embodiment of the present invention is provided including a coaxial connector including a body that provides the ground connection, a signal contact, a grounding post, and an anti-tipping lock body. The body includes a separable interface end and a mounting end. The separable interface end includes a mating contact. The signal contact and grounding post extend from the mounting end. The anti-tipping lock body is mounted to the body, and includes a board mounting feature extending from the anti-tipping lock body. The board mounting feature extends in a direction substantially parallel to the direction that the signal contact extends. The board mounting feature is adapted to maintain the coaxial connector assembly in place when the coaxial connector assembly is mounted to an electrical component, such as a circuit board.

The mating contact may extend in a direction substantially perpendicular to the signal contact. Additionally, the board mounting feature may include a post with a slot extending through at least a portion of the post, and/or a ring extending radially outward from the post.

The body may additionally include a recess accepting an anti-rotation block extending from the anti-tipping lock body. The recess and anti-rotation block cooperate to prevent the anti-tipping lock body from rotating relative to the body when they are mounted together. Further, the body may include a hole and the anti-tipping lock body may include a body mounting feature including a post. The hole accepts the post. The post has a slot extending through at least a portion of the post. Optionally, the post may include a ring extending radially outward from the post which cooperates with the hole to maintain the anti-tipping lock body in place when the anti-tipping lock body is mounted to the body.

The separable interface end may define a cylinder extending in a direction substantially perpendicular to the signal contact, and the body may include a hole substantially coaxial with the axis of the cylinder defined by the separable interface end. The anti-tipping lock body may include a body mounting feature accepted by the hole when the anti-tipping lock body is mounted to the body.

At least one embodiment of the present invention provides a coaxial connector comprising a body, a signal contact, a grounding post, and a board mounting feature. The body includes a separable interface portion and a mounting portion, and the separable interface portion includes a mating contact. A signal contact and a body grounding post extend from the mounting portion. The board mounting feature extends from the mounting portion in a direction substantially parallel to the direction the signal contact extends. The board mounting feature is adapted to maintain the coaxial connector in place when the coaxial connector is mounted to an electrical component.

At least one embodiment of the present invention provides an electrical connector system including a circuit board and a coaxial connector assembly. The circuit board includes first and second contact communication portions and a first mounting feature. The coaxial connector assembly is mounted to the circuit board and includes a separable interface end, a mounting end, and an anti-tipping member. The separable interface end includes a mating contact. A signal contact extends from the mounting end in a direction substantially perpendicular to the mating contact and electrically communicates with the first contact communication portion. A grounding post also extends from the mounting end and electrically communicates with the second contact communication portion. The coaxial connector system also includes an anti-tipping lock member with a second mounting feature extending therefrom. The second mounting feature cooperates with the first mounting feature to maintain the coaxial connector assembly in place when the coaxial connector assembly is mounted to the circuit board.

The separable interface end, mounting end, and anti-tipping member may be integral with each other. Further the first contact communication portion may include a pad adapted for electrical communication with the signal contact, and the second contact communication portion a hole adapted for electrical communication with the grounding post.

Certain embodiments of the present invention thus prevent tipping of connectors during the assembly process.

Little space is required, and cost of manufacture and assembly is low. Further, certain embodiments of the present invention provide a locking mechanism securing a connector to a circuit board.

Figure 1:
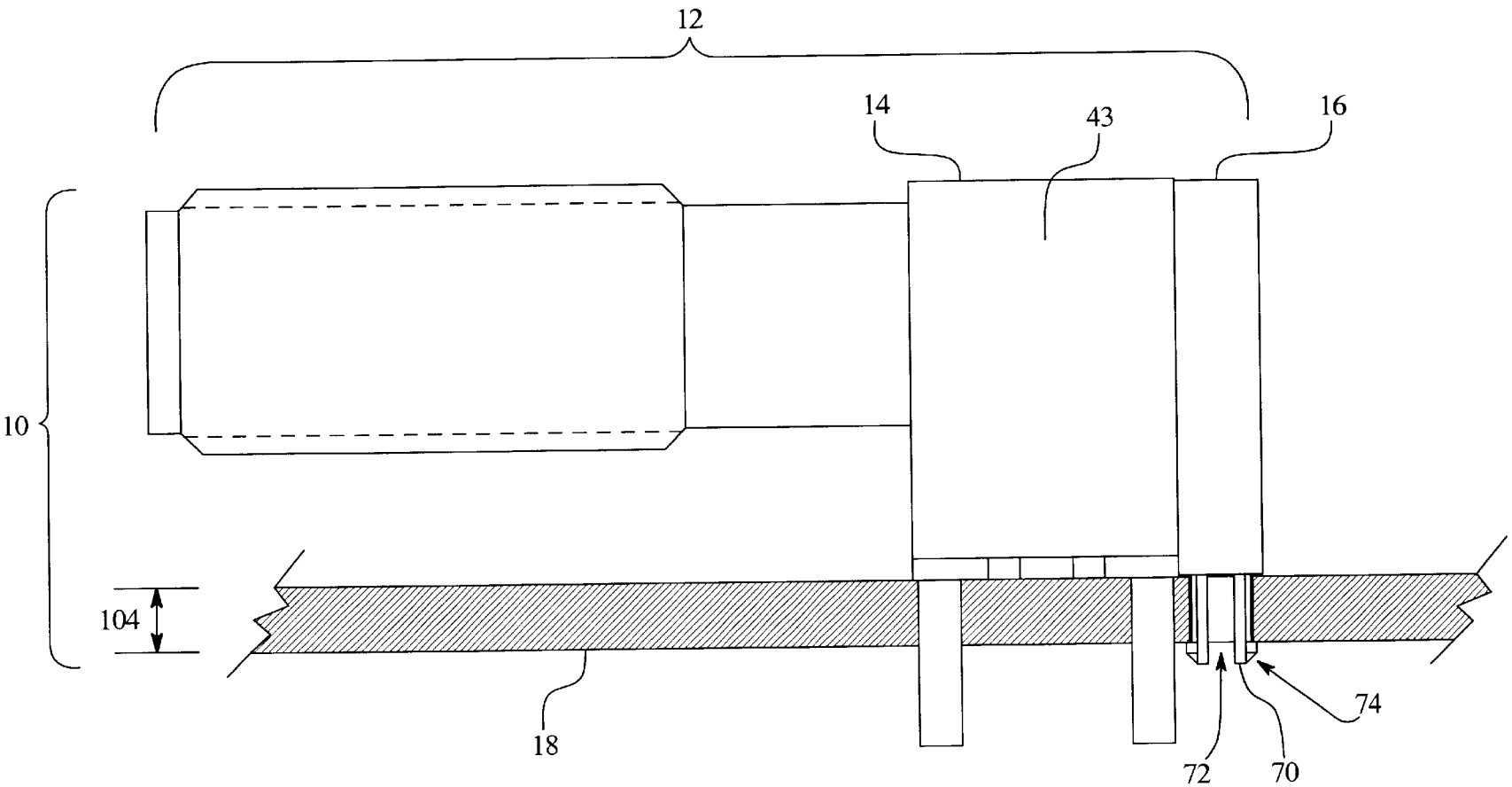
FIG. 1 illustrates an elevation view of an electrical system featuring an anti-tipping lock formed in accordance with an embodiment of the present invention.

The foregoing summary, as well as the following detailed description of the preferred embodiments of the present invention, will be better understood when read in conjunction with the appended drawings. For the purpose of illustrating the invention, there is shown in the drawings, embodiments which are presently preferred. It should be understood, however, that the present invention is not limited to the precise arrangements and instrumentality shown in the attached drawings.

DETAILED DESCRIPTION OF THE INVENTION

FIG. 1 illustrates a connector system 10 that includes a connector assembly 12 and a circuit board 18 to which the connector assembly 12 is mounted. The connector assembly 12 includes a connector 14 and an anti-tipping lock 16. The connector 14 is a metallized right angle connector.

Figure 2:
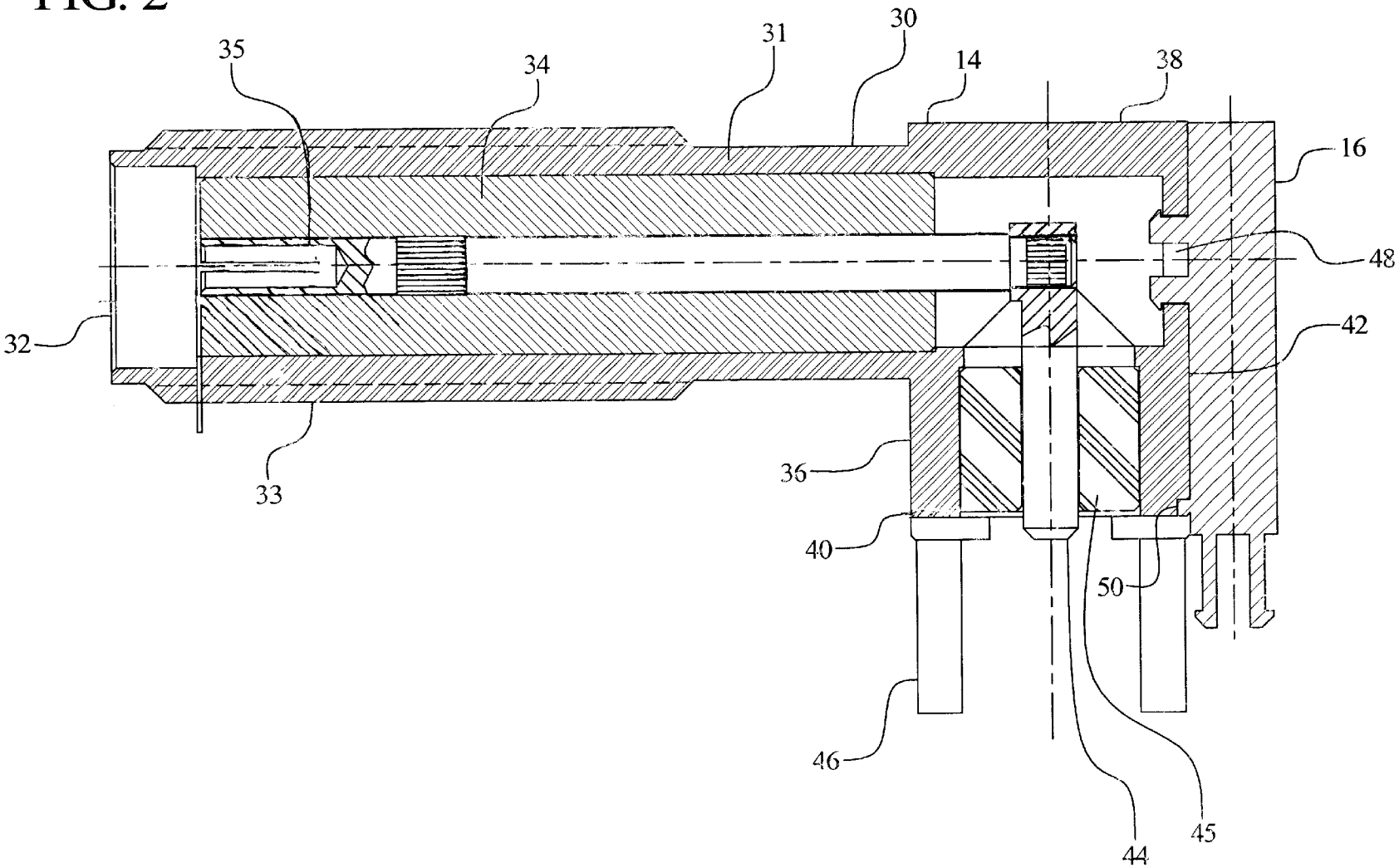
FIG. 2 illustrates a sectional elevation view of a right angle connector with an anti-tipping lock formed in accordance with an embodiment of the present invention.

FIG. 2 illustrates a sectional elevation view of the connector 14 with the anti-tipping lock 16 mounted to the connector 14. The connector 14 includes a body 30, a mating contact 35, a signal contact 44, and body grounding posts 46. The body 30 includes a metallized shell 31. The mating contact 35 electrically communicates with a mating connector (not shown) and the signal contact 44. The signal contact 44 also electrically communicates with the circuit board 18 (FIG. 1). Thus, the connector 14 provides a path of electrical communication between the circuit board 18 and the mating connector (not shown). Further, the body grounding posts 46 electrically communicate with the circuit board 18 and are integral to the metallized shell 31, and the metallized shell 31 electrically communicates with the mating connector (not shown). Thus, the connector 14 also provides a second path of electrical communication between the circuit board 18 and the mating connector (not shown).

The body 30 includes a separable interface or mating end 32 and a mounting end 36. The body 30 may be made from stainless steel with gold plating. The mating end 32 is cylindrically shaped and extends from the body 30 substantially perpendicularly to the mounting end 36, and mates with a mating connector. The mating end 32 includes a threaded portion 33, a mating dielectric 34, and the mating contact 35. The threaded portion 33 is sized to mate with a mating connector. The mating dielectric 34 is pressed into the metallized shell 31, and the mating contact 35 is pressed into the mating dielectric 34. The mating dielectric 34 provides physical support to the mating contact 35 and helps insulate the mating contact 35 from the metallized shell 31, thereby allowing two different paths of electrical conduction through the connector 14. Further, the dielectric material is selected to have a dielectric constant to provide a desired characteristic impedance. The dielectric material may be, for example, PTFE.

The mounting end 36 includes a top 38, a bottom 40, a back 42, sides 43 (see FIG. 1), the signal contact 44, a signal dielectric 45, and the body grounding posts 46. The signal contact 44 and body grounding posts 46 are configured to electrically communicate with the circuit board 18 when the connector 14 is mounted to the circuit board 18. The signal dielectric 45 is pressed into the metallized shell 31, and the signal contact 44 is pressed into the signal dielectric 45. The signal dielectric 45 provides physical support to the signal contact 44 and helps insulate the signal contact 44 from the metallized shell 31, thereby allowing two different paths of electrical conduction through the connector 14. The dielectric material is selected to have a dielectric constant to provide a desired characteristic impedance.

The signal contact 44 and body grounding posts 46 extend from the bottom 40 of the mounting end 36. The signal contact 44 may be made of beryllium copper with gold plating and the body grounding posts 46 may be made of stainless steel with gold plating. The bottom 40 of the mounting end 36 rests at or near the top surface of the circuit board 18 when the connector 14 is mounted to the circuit board 18. In the illustrated embodiments, the signal contact 44 is cylindrically shaped, and the body grounding posts 46 are integral to the body 30 and have rectangular cross-sections. The top 38 is located opposite the bottom 40, and may provide a vacuum pick-up surface to facilitate automated placement of the connector 14. The sides 43 and back 42 join the top 38 and bottom 40 of the mounting end.

The back 42 includes a lock mounting hole 48 and an anti-rotation recess 50. In alternate embodiments, depending on the space available on the circuit board 18, the lock mounting hole 48 and the anti-rotation recess 50 may be located on one of the sides 43. The lock mounting hole 48 and anti-rotation recess 50 are sized to cooperate with the anti-tipping lock 16 when the anti-tipping lock 16 is mounted to the connector 14. The lock mounting hole 48 may be co-axial with the cylindrically shaped separable interface or mating end 32 to provide for ease of manufacture. In the illustrated embodiment, the anti-rotation recess 50 is located proximal to the bottom 40 of the mounting end 36, but may be located elsewhere in alternate embodiments.

Figure 3:
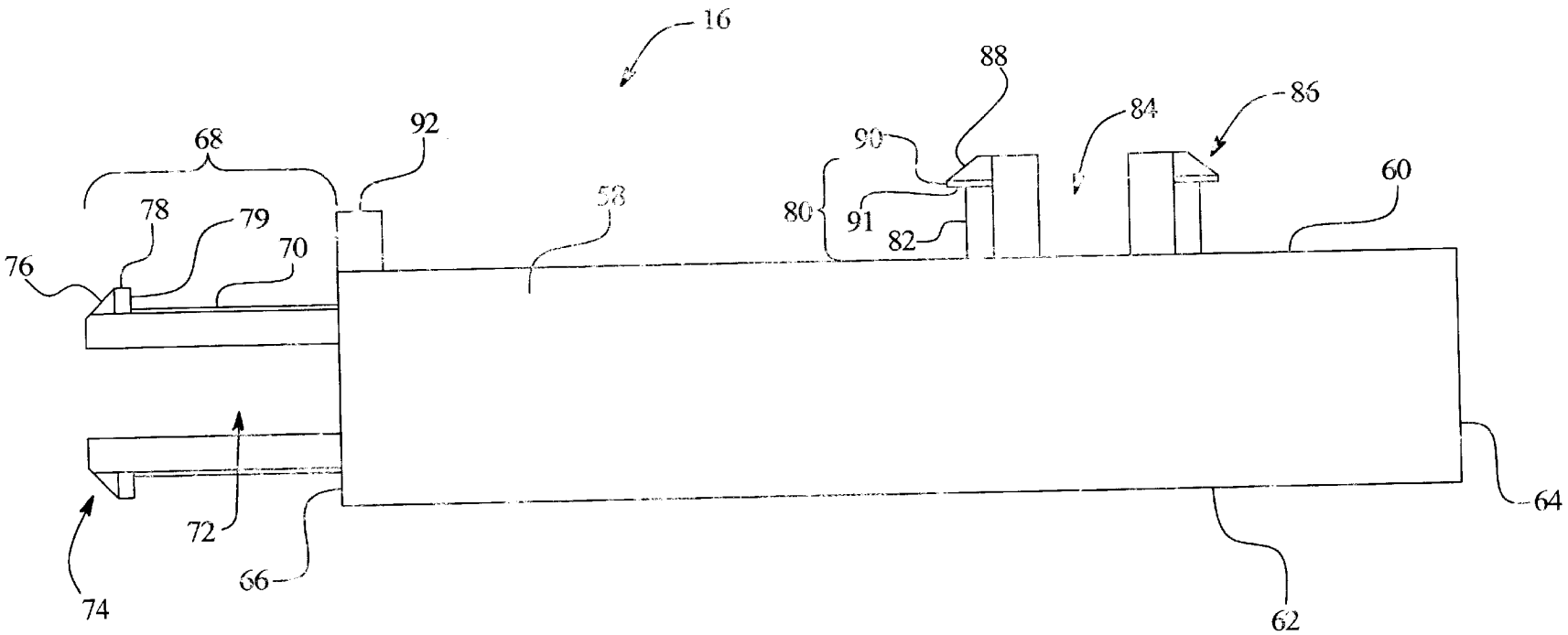
FIG. 3 illustrates a side elevation view of an anti-tipping lock formed in accordance with an embodiment of the present invention.
Figure 4:
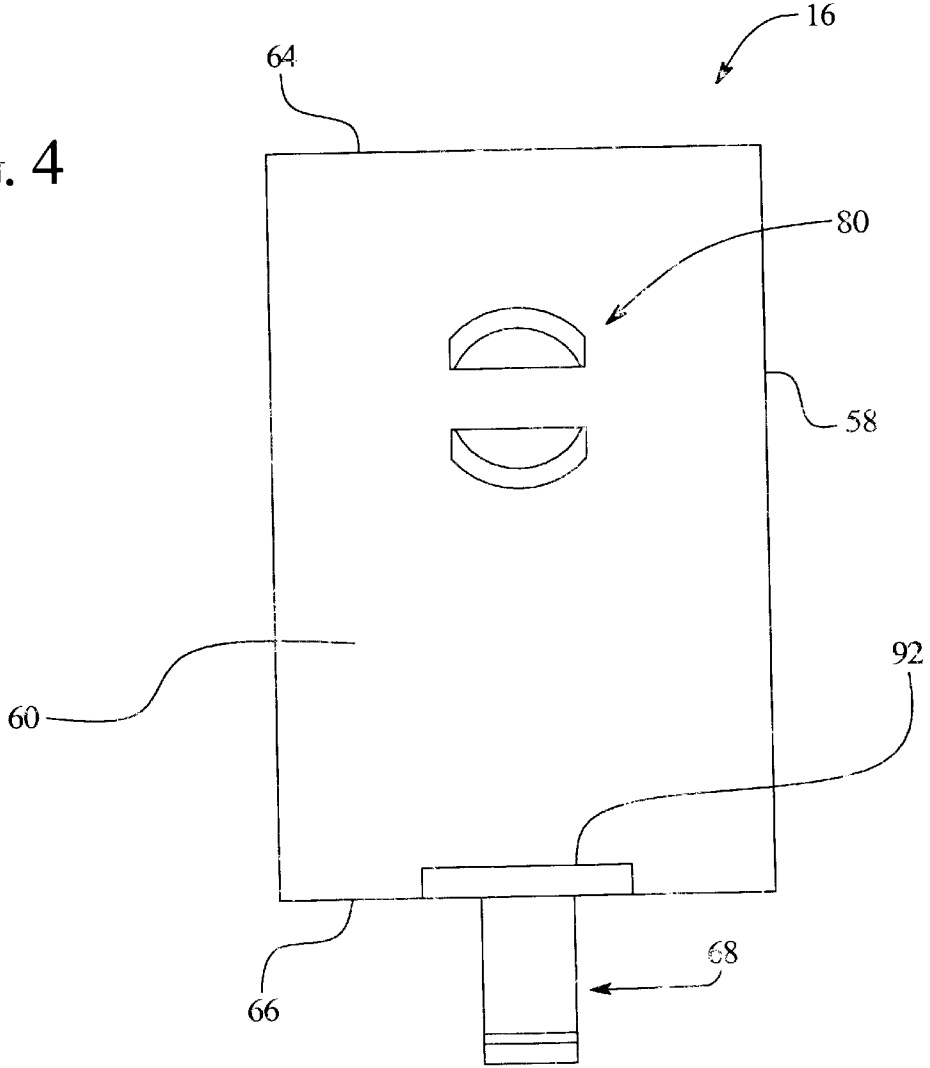
FIG. 4 illustrates a front elevation view of an anti-tipping lock formed in accordance with an embodiment of the present invention.

FIGS. 3 and 4 illustrate elevation views of the anti-tipping lock 16. The anti-tipping lock 16 includes a body 58, a board mounting feature 68, a body mounting feature 80, and an anti-rotation block 92. The body 58 includes a front 60, a back 62, a top 64, and a bottom 66.

The bottom 66 of the anti-tipping lock 16 rests at or near the top surface of the circuit board 18 when the connector 14 and anti-tipping lock 16 are mounted and in place on the circuit board 18. The board mounting feature 68 extends from the bottom 66 of the anti-tipping lock 16. The board mounting feature 68 includes a post 70, a slot 72, and a retention feature 74. The retention feature 74 includes a leading edge 76, a ring 78, and a locking surface 79. The retention feature 74 is located toward the outer end of the post 70 farthest from the bottom 66 of the anti-tipping lock 16. The post 70 is generally cylindrically shaped, with the slot 72 extending through the axis of the post 70. Starting from a point farthest away from the body 58 and extending back toward the body 58, the leading edge 76 has a flared increasing diameter up to the ring 78. The smallest diameter of the leading edge 76 is less than the diameter of the corresponding locking hole of the circuit board 18, and the largest diameter of the leading edge 76 exceeds the diameter of the locking hole of the circuit board 18. Traversing still further toward the body 58, the ring 78 terminates at a stepped decrease in the diameter of the post 70 including the locking surface 79.

The front 60 of the anti-tipping lock 16 faces the back 42 of the connector 14 and rests at or near the back 42 when the anti-tipping lock 16 is mounted to the connector 14. The body mounting feature 80 extends from the front 60 of the anti-tipping lock 16. The body mounting feature 80 includes a post 82, a slot 84, and a retention feature 86. The retention feature 86 includes a slanted leading edge 88, a ring 90, and a locking surface 91. The retention feature 86 is located toward the end of the post 82 farthest from the front 60 of the anti-tipping lock 16. The post 82 is generally cylindrically shaped, with the slot 84 extending through the axis of the post 82. Starting from a point farthest away from the body 58 and extending back toward the body 58, the leading edge 88 has a flared increasing diameter until it contacts the ring 90. The smallest diameter of the leading edge 88 is less than the diameter of the lock mounting hole 48 of the connector 14, and the largest diameter of the leading edge 88 exceeds the diameter of the lock mounting hole 48 of the connector 14. Traversing still further toward the body 58, the ring 90 terminates at a stepped decrease in the diameter of the post 82 including the locking surface 91. The anti-rotation block 92 protrudes from the front 60 of the anti-tipping lock proximal to the bottom 66 of the anti-tipping lock. The anti-tipping lock 16 may be molded in one piece from polyester.

To mount the anti-tipping lock 16 to the connector 14, the anti-tipping lock 16 and the connector 14 are positioned with the front 60 of the anti-tipping lock 16 facing the back 42 of the connector 14, the body mounting feature 80 substantially in line with the lock mounting hole 48, and the anti-rotation block 92 aligned with the anti-rotation recess 50. Next, the anti-tipping lock 16 and connector 14 are urged toward each other. As the anti-tipping lock 16 approaches the connector 14, the leading edge 88 encounters the lock mounting hole 48. Further urging the anti-tipping lock 16 and connector 14 together results in the contact between the leading edge 88 and the lock mounting hole 48 resiliently compressing the retention feature 86 of the body mounting feature 80. Still further urging results in the ring 90 penetrating the thickness of the metallized shell 31 through the lock mounting hole 48, which results in the retention feature 86 returning to its unbiased shape. With the anti-tipping lock 16 positioned as described, the locking surface 91 cooperates with the metallized shell 31 to lock the anti-tipping lock 16 in place. Further, the anti-rotation block 92 fits in the anti-rotation recess 50, and they cooperate to prevent the anti-tipping lock from rotating, thereby maintaining the board mounting feature 68 in proper alignment during the assembly process.

Figure 5:
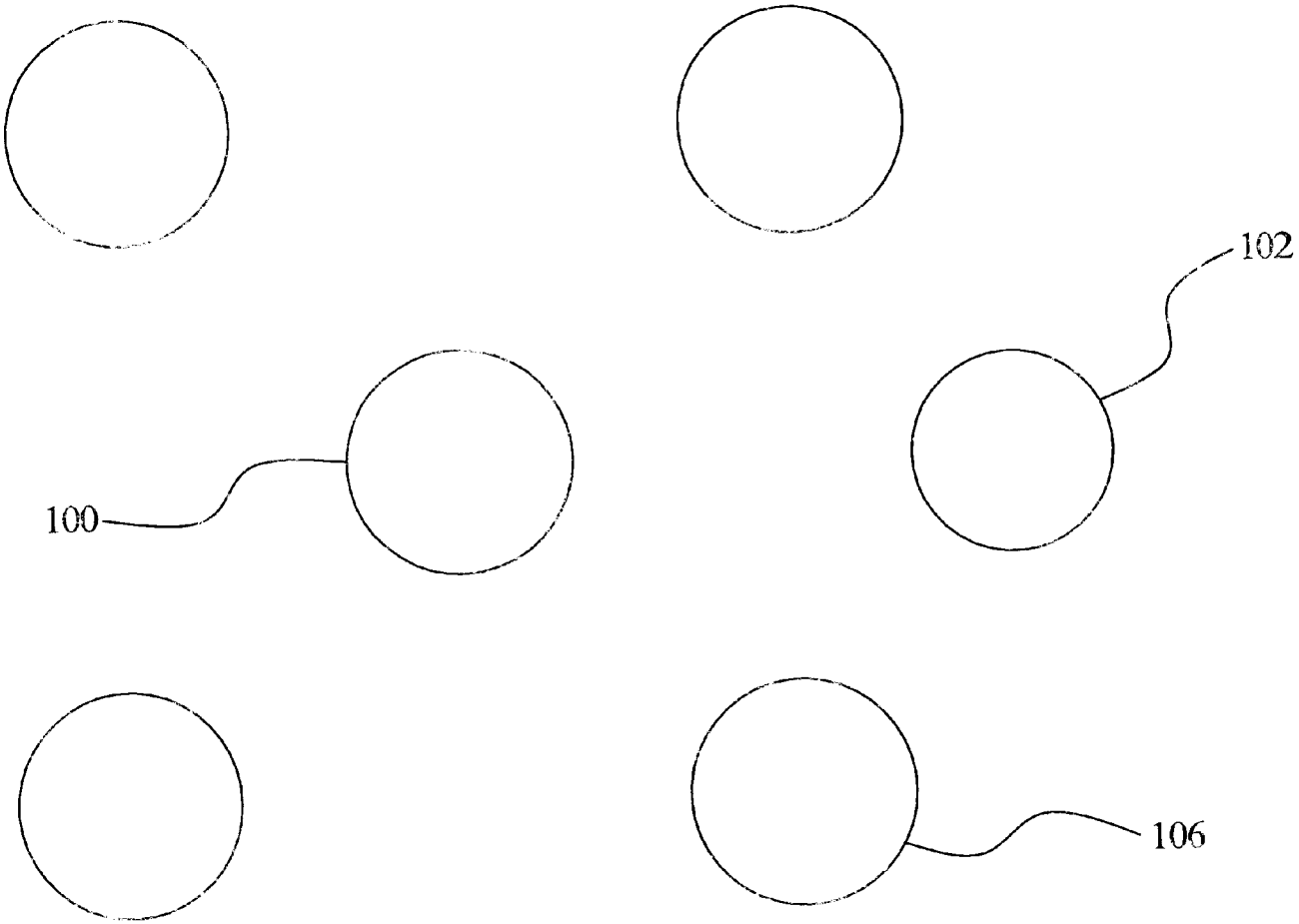
FIG. 5 illustrates a top plan view of the connector mounting area on a circuit board formed in accordance with an embodiment of the present invention.

FIG. 5 illustrates a top view of a portion of the circuit board 18. The circuit board 18 includes a contact pad 100, grounding holes 106, and a locking hole 102. The circuit board has a thickness 104 (see FIG. 1). The contact pad 100 is a circular pad to which the signal contact 44 is soldered and with which the signal contact 44 electrically communicates. The grounding holes 106 are configured and sized to accept the body grounding posts 46 with a clearance. The clearance allows for easier placement of the connector 14 on the circuit board 18. The body grounding posts 46 are also soldered to the grounding holes 106, and the body grounding posts 46 are in electrical communication with the grounding holes 106. The locking hole 102 is located and sized to cooperate with the board mounting feature 68 to maintain the connector 14 in place and prevent the connector 14 from tipping.

To mount the connector 14 (with the anti-tipping lock 16 in place) to the circuit board 18, the connector 14 is positioned with the bottom 40 facing the top of the circuit board 18, the signal contact 44 directly above the contact pad 100, the body grounding posts 46 directly above the grounding holes 106, and the board mounting feature 68 directly above the locking hole 102. Next, the connector 14 is lowered toward the circuit board 18. The direction that the connector 14 is lowered is substantially perpendicular to the circuit board 18 and is the board mating direction. As the connector 14 approaches the circuit board 18, the leading edge 76 encounters the locking hole 102. Further lowering the connector 14 results in the contact between the leading edge 76 and the locking hole 102 resiliently compressing the retention feature 74 of the board mounting feature 68. Simultaneously, the body grounding posts 46 enter the grounding holes 106. Still further urging results in the ring 78 penetrating the thickness 104 of the circuit board 18 through the locking hole 102, which results in the retention feature 74 returning to its unbiased shape. With the connector 14 positioned as described, the locking surface 79 cooperates with the underside of the circuit board 18 to lock the connector 14 in place. The board mounting feature 68 cooperates with the locking hole 102 to maintain the connector 14 in place and to prevent tipping before the connector 14 is soldered to the circuit board 18. Because the anti-tipping lock 16 interacts mechanically with circuit board 18, the anti-tipping lock 16 takes may take up less room on the circuit board 18 than a counterweight, while still providing more secure positioning and improved protection against tipping.

With the connector in place, the body grounding posts 46 are soldered to the grounding holes 106, forming an outer path of electrical communication from the grounding holes 106, through the body grounding posts 46, and then through the metallized shell 31 to the mating connector (not shown). The signal contact 44 is soldered to the contact pad 100, forming an inner electrical communication path from the contact pad 100, through the signal contact 44, then through the mating contact 35 to the mating connector (not shown).

Figure 6:
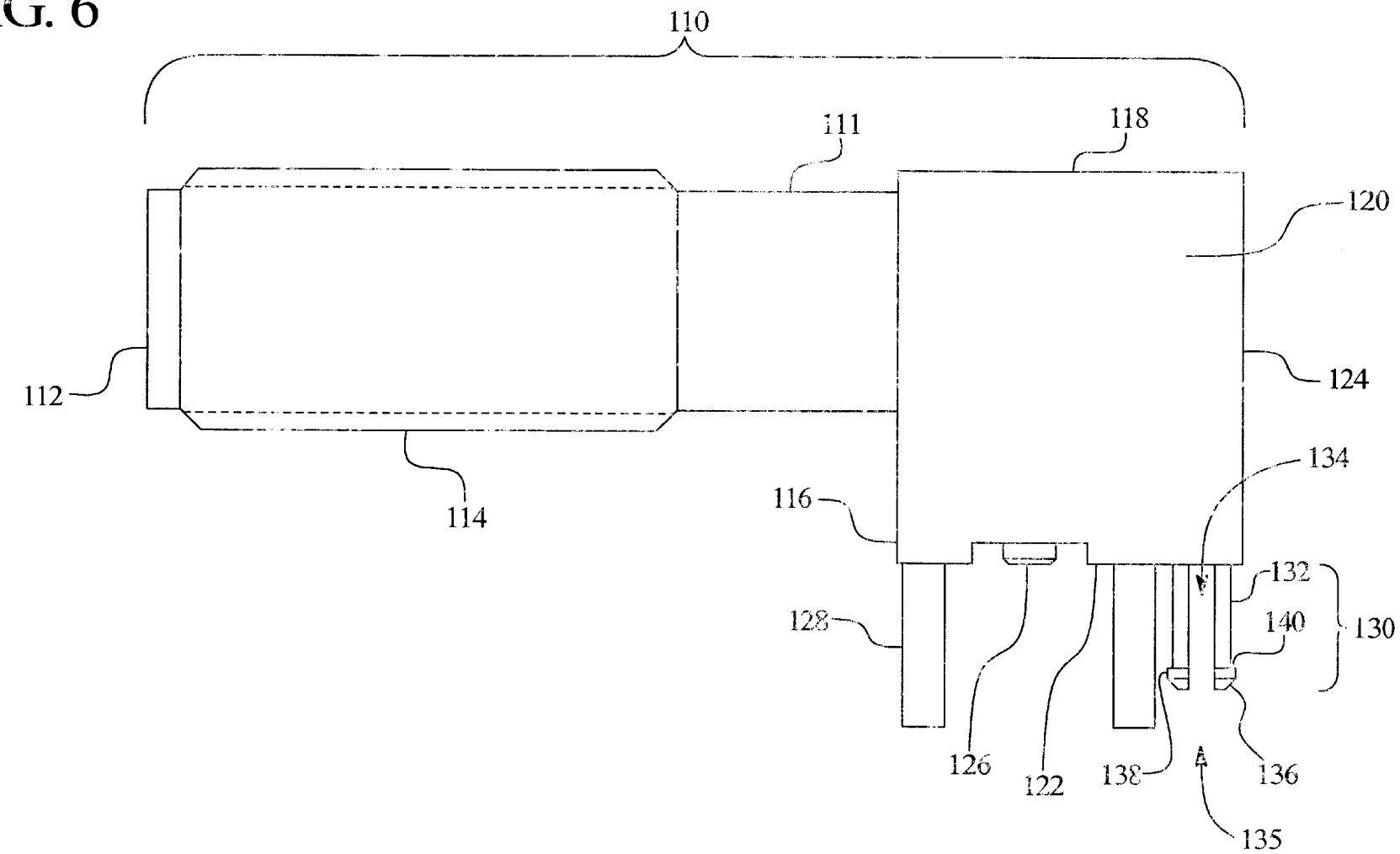
FIG. 6 illustrates a side elevation view of a right angle connector with an integral anti-tipping lock formed in accordance with an embodiment of the present invention.
Figure 7:
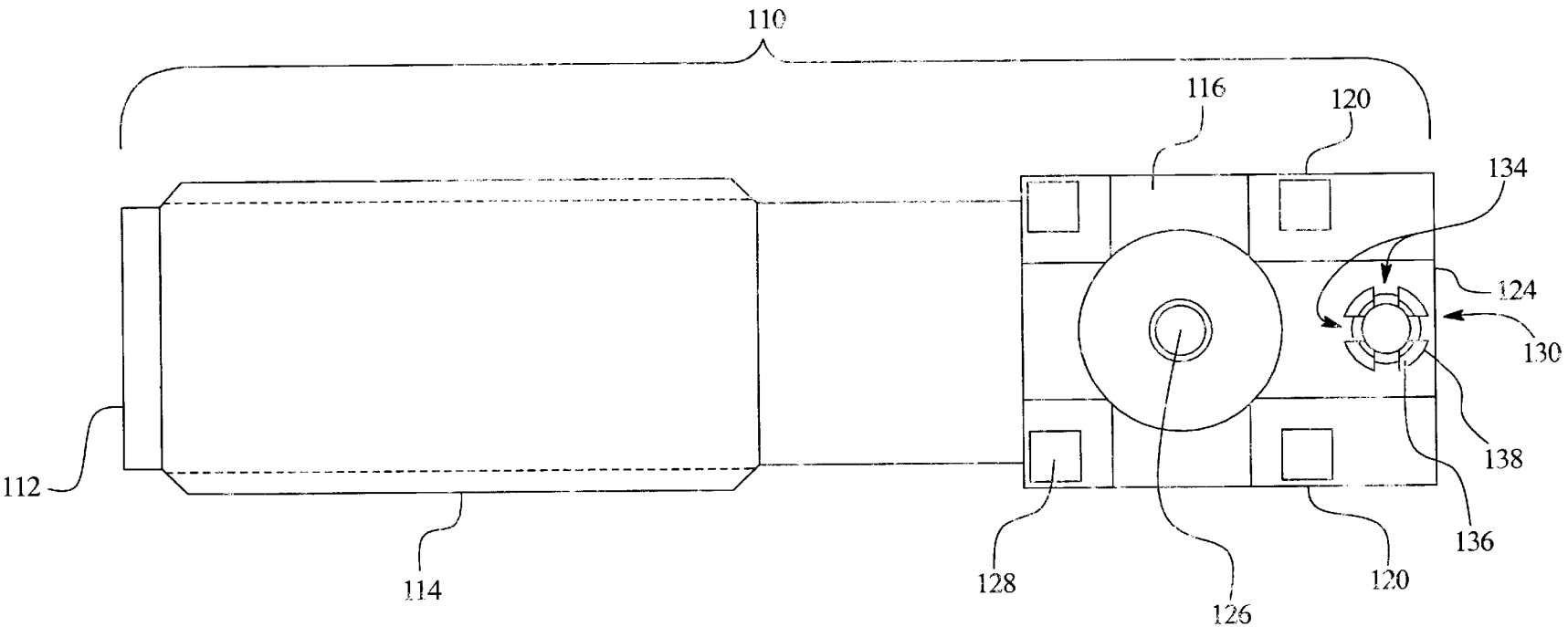
FIG. 7 illustrates a bottom view of the right angle connector of FIG. 6.

FIGS. 6 and 7 illustrate a connector 20 with an integral anti-tipping lock body. Put another way, the connector and anti-tipping lock body are unitary. The connector 20 includes a body 110 having a separable interface or mating end 112 and a mounting end 116. The layout of contacts and dielectrics within the connector 20 is similar to that for the connector 14. The mating end 112 is cylindrically shaped and extends from the body 110 substantially perpendicularly to the mounting end 116, and mates with a mating connector. The mating end 112 includes a threaded portion 114 sized to mate with a mating connector. The connector 20 may also be used with the circuit board 18.

The mounting end 116 includes a top 118, a bottom 122, a back 124, sides 120, a signal contact 126, and grounding posts 128. The signal contact 126 and grounding posts 128 are configured to electrically communicate with the circuit board 18 when the connector 20 is mounted to the circuit board 18.

The bottom 122 of the mounting end 116 rests at or near the top surface of the circuit board 18 when the connector 20 is mounted to the circuit board 18. In the illustrated embodiment, the signal contact 126 is cylindrically shaped, and the grounding posts 128 have rectangular cross-sections. The top 118 is located opposite the bottom 122, and may provide a vacuum pick-up surface to facilitate automated placement of the connector 20. The sides 120 and back 124 join the top 118 and bottom 122 of the mounting end.

The board mounting feature 130 extends from the bottom 122 of the connector 20 near the back 124 of the connector. In the illustrated embodiment, the board mounting feature 130 is pressed into the bottom 122 of the mounting end 116. The board mounting feature 130 includes a post 132, a slot 134, and a retention feature 135. The retention feature 135 includes a leading edge 136, a ring 138, and a locking surface 140. The retention feature 135 is located toward the end of the post 132 farthest from the bottom 122 of the connector 20. The post 132 is generally cylindrically shaped, with two slots 134 extending through the axis of the post 132. The post 132 may be made of a metal clip pressed into the bottom 122 of the connector 20. Because the metal may be fairly rigid, two slots 134 may be used instead of just one slot, as in the previously illustrated embodiment, to insure that the board mounting feature 130 does not require undue force to be biased. In alternate embodiments, different numbers of slots could be used. Starting from a point farthest away from the body 110 and extending back toward the body 110, the leading edge 136 has a relatively increasing diameter until it contacts the ring 138. The smallest diameter of the leading edge 136 is less than the diameter of the corresponding locking hole 106 of the circuit board 18, and the largest diameter of the leading edge 76 exceeds the diameter of the locking hole 106 of the circuit board 18. Traversing still further toward the body 110, the ring 138 terminates at a stepped decrease in the diameter of the post 132 including the locking surface 140. The connector 20 is mounted to the circuit board in a similar fashion to that used for the connector 14.

While particular elements, embodiments and applications of the present invention have been shown and described, it will be understood, of course, that the invention is not limited thereto since modifications may be made by those skilled in the art, particularly in light of the foregoing teachings. For example, the board and/or body mounting features might not include a ring or other retaining element but may instead rely solely on the resiliency of the mounting feature to maintain position. Alternatively, the mounting features may include a ring that does not extend completely through a mounting hole, but instead applies sufficient pressure to the inside wall of a mounting hole to maintain the feature in the hole and prevent the connector from tipping. Further, the signal contact may electrically communicate with a hole in the circuit board instead of a pad. It is therefore contemplated by the appended claims to cover such modifications as incorporate those features which come within the spirit and scope of the invention.

What is claimed is:

1. An electrical connector assembly comprising:

a body including a separable interface end and a mounting end, said separable interface end having a mating portion including a mating contact;

a signal contact extending outwardly from said mounting end adapted to join a circuit board when inserted along a board mating direction;

a grounding post extending from said mounting end; and an anti-tipping lock mounted to a side of said body, said anti-tipping lock comprising a body having a board mount extending therefrom in a direction substantially parallel to the board mating direction, said board mount being adapted to maintain said electrical connector assembly in place on said circuit board;

wherein said body includes a recess, and said anti-tipping lock includes an anti-rotation block extending therefrom in a direction substantially perpendicular to the board mating direction, said recess accepting said anti-rotation block to prevent said anti-tipping body from rotating relative to said body when said anti-tipping body is mounted to said body.

2. The electrical connector assembly of claim 1 wherein said mating contact extends in a direction substantially perpendicular to said signal contact.

3. The electrical connector assembly of claim 1 wherein said board mount includes a post and a slot extending through at least a portion of said post, said being adapted to extend through holes in a circuit board.

4. The electrical connector assembly of claim 1 wherein said board mount includes a post, and a ring extending radially outward from said post, said ring being adapted to securely engage a bottom side of a circuit board.

5. The electrical connector assembly of claim 1 wherein said body includes a hole, and said anti-tipping lock includes a body mounting feature including a post and a slot extending through at least a portion of said post, said hole accepting said mounting feature when said anti-tipping lock body is mounted to said body.

6. The electrical connector assembly of claim 1 wherein said body includes a hole, and said anti-tipping lock includes a body mounting feature, said body mounting feature including a post, and a ring extending radially outward from said post, said hole accepting said body mounting feature when said anti-tipping lock body is mounted to said body, said ring penetrating through said hole and cooperating with said hole to maintain said anti-tipping lock body in place when said anti-tipping body is mounted to said body.

7. The electrical connector assembly of claim 1 wherein said separable interface end defines a cylinder extending in a direction substantially perpendicular to said signal contact, said body includes a hole aligned substantially coaxial with the axis of said cylinder defined by said separable interface end, and said anti-tipping lock body includes a body mounting feature, said hole accepting said body mounting feature when said anti-tipping lock body is mounted to said body.

8. An electrical connector comprising:

a body including a mating portion and a mounting portion, said mating portion including a mating contact;

a signal contact extending outwardly from said mounting portion adapted to join a circuit board when inserted along a board mating direction;

a grounding post extending from said mounting portion;

an anti-tipping lock having an anti-rotation block received in a recess in a face of said mounting portion; and a board mounting member extending from said anti-tipping lock in a direction substantially parallel to the board mating direction, said board mount being adapted to maintain said electrical connector in place on an said circuit board.

9. The electrical connector of claim 8 wherein said mating contact extends in a direction substantially perpendicular to said signal contact.

10. The electrical connector of claim 8 wherein said board mount comprises a post and a slot extending through at least a portion of said post.

11. The electrical connector of claim 8 wherein said board mount includes a post, and a ring extending radially outward from said post.

12. An electrical connector system comprising:

a circuit board including a first contact communication portion, a second contact communication portion, and a first mounting feature; and a connector assembly having a mounting end mounted to said circuit board and a separable interface end configured to be joined with another connector, said separable interface end having a mating portion including a mating contact, said mounting end including a signal contact extending therefrom and electrically communicating with said first contact communication portion, said mounting end further including a grounding post extending therefrom and electrically communicating with said second contact communication portion; and an anti-tipping member with a second mounting feature extending therefrom, said anti-tipping member mounted to said connector, said second mounting feature cooperating with said first mounting feature to maintain said connector assembly in place when said connector assembly is mounted to said circuit board;

wherein said mounting end includes a recess and said anti-tipping member includes an anti-rotation block extending therefrom in a direction substantially perpendicular to a board mating direction of said mounting end, said recess accepting said anti-rotation block to prevent said anti-tipping member from rotating relative to said mounting end when said anti-tipping member is mounted to said mounting end.

13. The electrical connector system of claim 12 wherein said connector assembly includes a connector body including said separable interface end and said mounting end, and said anti-tipping member includes an anti-tipping lock body mountable to said connector body, said second mounting feature extending from said anti-tipping lock body.

14. The electrical system of claim 12, wherein said separable interface end, mounting end, and anti-tipping member are integral.

15. The electrical system of claim 12, wherein said first mounting feature includes a hole, and said second mounting feature includes a post and a slot extending through at least a portion of said post, said post sized to be resiliently accepted by said hole.

16. The electrical system of claim 12 wherein said first mounting feature includes a hole, and said second mounting feature includes a post and a ring extending radially outward from said post, said hole accepting said post when said connector assembly is mounted to said circuit board, said ring penetrating through said hole and cooperating with said hole to maintain said connector assembly in place when said connector assembly is mounted to said circuit board.

17. The electrical system of claim 12 wherein said second contact communication portion includes a grounding post hole sized to provide a clearance when accepting said grounding post.

18. The electrical system of claim 12 wherein said first contact communication portion includes a pad adapted for electrical communication with said signal contact, and said second contact communication portion includes a grounding post hole adapted for electrical communication with said grounding post.

* * * * *